US007469704B2

(12) United States Patent
Fransson

(10) Patent No.: US 7,469,704 B2
(45) Date of Patent: Dec. 30, 2008

(54) DISHWASHER WITH COLLECTING MEANS FOR RECEIVING DISH LIQUID AND RINSE LIQUID

(75) Inventor: Roger Fransson, Växjö (SE)

(73) Assignee: Wexiodisk AB, Vaxjo (SE)

( * ) Notice: Subject to any disclaimer, the term of this patent is extended or adjusted under 35 U.S.C. 154(b) by 548 days.

(21) Appl. No.: 10/516,503

(22) PCT Filed: May 30, 2003

(86) PCT No.: PCT/SE03/00887

§ 371 (c)(1),
(2), (4) Date: May 17, 2005

(87) PCT Pub. No.: WO03/101275

PCT Pub. Date: Dec. 11, 2003

(65) Prior Publication Data

US 2005/0211277 A1 Sep. 29, 2005

(30) Foreign Application Priority Data

Jun. 4, 2002 (SE) ..... 0201680

(51) Int. Cl.
*B08B 3/02* (2006.01)

(52) U.S. Cl. ..... 134/56 D

(58) Field of Classification Search ..... 134/56 D
See application file for complete search history.

(56) References Cited

U.S. PATENT DOCUMENTS 3,989,054 A * 11/1976 Mercer ..... 134/104.1
4,641,671 A * 2/1987 Nogi et al. ..... 134/57 D
5,660,193 A * 8/1997 Archer et al. ..... 134/56 D
5,829,459 A * 11/1998 Milocco et al. ..... 134/57 D
5,992,954 A * 11/1999 Becker ..... 312/228

FOREIGN PATENT DOCUMENTS

DE 1 270 239 B 6/1968
DE 26 15 846 A1 10/1977

* cited by examiner

*Primary Examiner*—Frankie L. Stinson
*Assistant Examiner*—Samuel A Waldbaum
(74) *Attorney, Agent, or Firm*—Harness, Dickey & Pierce, P.L.C.

(57) ABSTRACT

A one compartment dishwasher (1) has a dishwashing compartment, in which spray means (4*b*) for spraying dishwashing liquid and rinsing liquid are arranged, a dishwashing container (5) and a rinsing container (6). The dishwashing container (5) communicates with the dishwashing compartment to receive through a collecting plate (8) liquid that has been discharged by the spray means (4*b*). The dishwasher has a recirculation rinsing container (7) for recirculation rinsing liquid which during a pre-rinsing phase preceding the rinsing phase is to be supplied to the dishwashing compartment by the spray means (4*b*). The collecting plate (8) has a first outlet means (9) which is adapted to conduct collected liquid to the recirculation rinsing container (7), and a second outlet means (10, 11) which is adapted to conduct collected liquid to the dishwashing container (5) when the recirculation rinsing container (7) is filled up. In a method for batchwise washing of articles in such a dishwasher, the articles in each batch are pre-rinsed during the pre-rinsing phase by means of recirculated rinsing liquid.

5 Claims, 4 Drawing Sheets

DISHWASHER WITH COLLECTING MEANS FOR RECEIVING DISH LIQUID AND RINSE LIQUID

FIELD OF THE INVENTION

The present invention relates to a one compartment dishwasher, having a dishwashing compartment which is adapted to contain articles to be washed and in which spray means for spraying dishwashing liquid and rinsing liquid are arranged, a dishwashing container, which is arranged under the dishwashing compartment and adapted to contain dishwashing liquid which in a dishwashing phase is to be supplied to the dishwashing compartment by the spray means, and a rinsing container, which is adapted to contain rinsing liquid which in a rinsing phase is to be supplied to the dishwashing compartment by the spray means, the dishwashing container communicating with the dishwashing compartment to receive, through a collecting means, dishwashing liquid and rinsing liquid which have been discharged by the spray means.

BACKGROUND ART

A one compartment dishwasher of the type used in large-scale kitchens and restaurants is in most cases a dishwasher with hood but may also be a front-loaded dishwasher. In the one compartment dishwasher, articles to be washed are placed in a rack which is placed in the dishwasher compartment of the dishwasher and is retained there during a dishwashing programme. During the dishwashing programme, the articles are first flushed with a dishwashing liquid and then with a rinsing liquid. The dishwashing liquid is circulated from the dishwashing container to the dishwashing compartment, over the articles and back to the dishwashing container. The dishwashing liquid is heated to about 60° C. and a dishwashing detergent is added. The rinsing liquid is completely pure liquid from the rinsing container, which liquid is heated to about 85° C. and a drying agent is added. After rinsing, the rinsing liquid flows down into the dishwashing container and dilutes the dishwashing liquid, which means that dishwashing detergent must be added to a corresponding degree after each dishwashing programme. In each rinsing, the rinsing liquid and the drying agent therein are thus consumed. In each rinsing, about 3-5 l of rinsing liquid is consumed. In view of the frequency of use for this type of dishwasher, it is important for both environmental and economical reasons to reduce, during each dishwashing programme, the consumption of energy, water and additives, however without increasing the volume of the dishwasher.

SUMMARY OF THE INVENTION

The object of the invention is to provide a dishwasher which makes it possible to use less energy, a smaller amount of water and a smaller amount of additives, with retained dishwashing result.

According to the invention, this object is achieved by a dishwasher which is of the type defined by way of introduction and characterised by a recirculation rinsing container which is arranged under the dishwashing compartment and adapted to contain recirculation rinsing liquid, which in a pre-rinsing phase preceding the rinsing phase is to be supplied to the dishwashing compartment by the spray means, the collecting means having a first outlet means which is adapted to conduct liquid collected by the collecting means to the recirculation rinsing container, and a second outlet means which is adapted to conduct liquid collected by the collecting means to the dishwashing container when the recirculation rinsing container is filled up.

In a dishwasher according to the invention, the rinsing liquid can be reused during a pre-rinsing phase which precedes the rinsing phase, thus causing a smaller amount of pure rinsing liquid to be consumed during each dishwashing programme. When the rinsing liquid is reused, the consumption of completely pure rinsing liquid in the rinsing phase can be almost halved, which causes the consumption of drying agent and the liquid heating cost to be reduced correspondingly. Since the dilution of the dishwashing liquid is reduced, also the amount of dishwashing detergent that must be added after each dishwashing programme is reduced.

According a preferred embodiment of the invention, the collecting means of the dishwasher is a collecting plate which is arranged between the dishwashing compartment and the dishwashing container and which has a first through opening which communicates with the recirculation rinsing container and forms said first outlet means, and a second through opening which communicates with the dishwashing container and round which a circumferential frame is arranged, said frame projecting upwards from the collecting plate, the second outlet means consisting of a hole formed in the frame and said second opening, and said first opening being arranged essentially opposite to the hole and close to the frame, preferably outside the frame, but it is also possible to arrange the first opening wholly or partly inside the frame. By means of these openings, the dishwashing liquid and the rinsing liquid are conducted to the dishwashing container and the recirculation rinsing container, respectively, in a simple and reliable manner, without requiring the use of moving parts, such as valves and the like.

Preferably, the collecting plate has portions which are inclined relative to the horizontal plane, downwards to the first outlet means, which causes liquid collected on the collecting plate to flow down to the first outlet means by itself.

Moreover the dishwasher according to the invention can have a further collecting means for liquid, which has been discharged by the spray means, said further collecting means being arranged over at least part of the second opening to conduct said liquid to the collecting plate, which causes part of the liquid that otherwise would have passed directly to the dishwashing container to be collected by the collecting plate.

The second collecting means preferably consists of a channel arranged over said part of the second opening.

BRIEF DESCRIPTION OF THE DRAWINGS

The invention will now be described in more detail by means of a preferred, but non-limiting embodiment.

DESCRIPTION OF A PREFERRED EMBODIMENT

Figure 1:
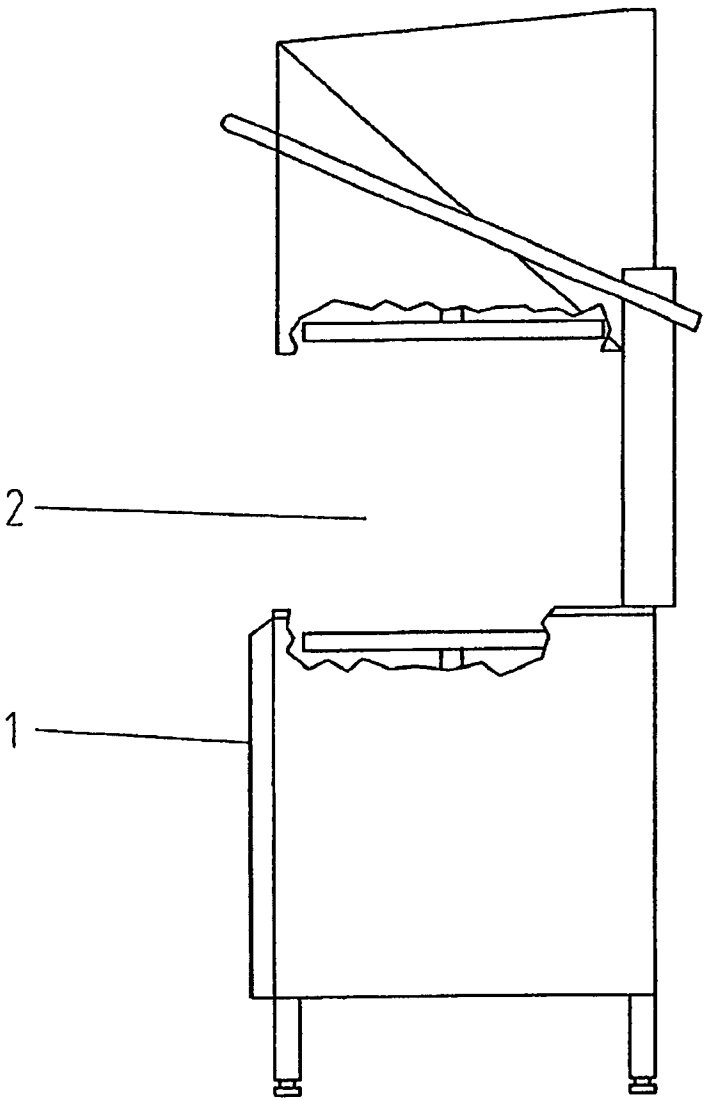
FIG. 1 is a side view and shows a dishwasher according to the invention with a hood in an open position and with some portions broken away.
Figure 2:
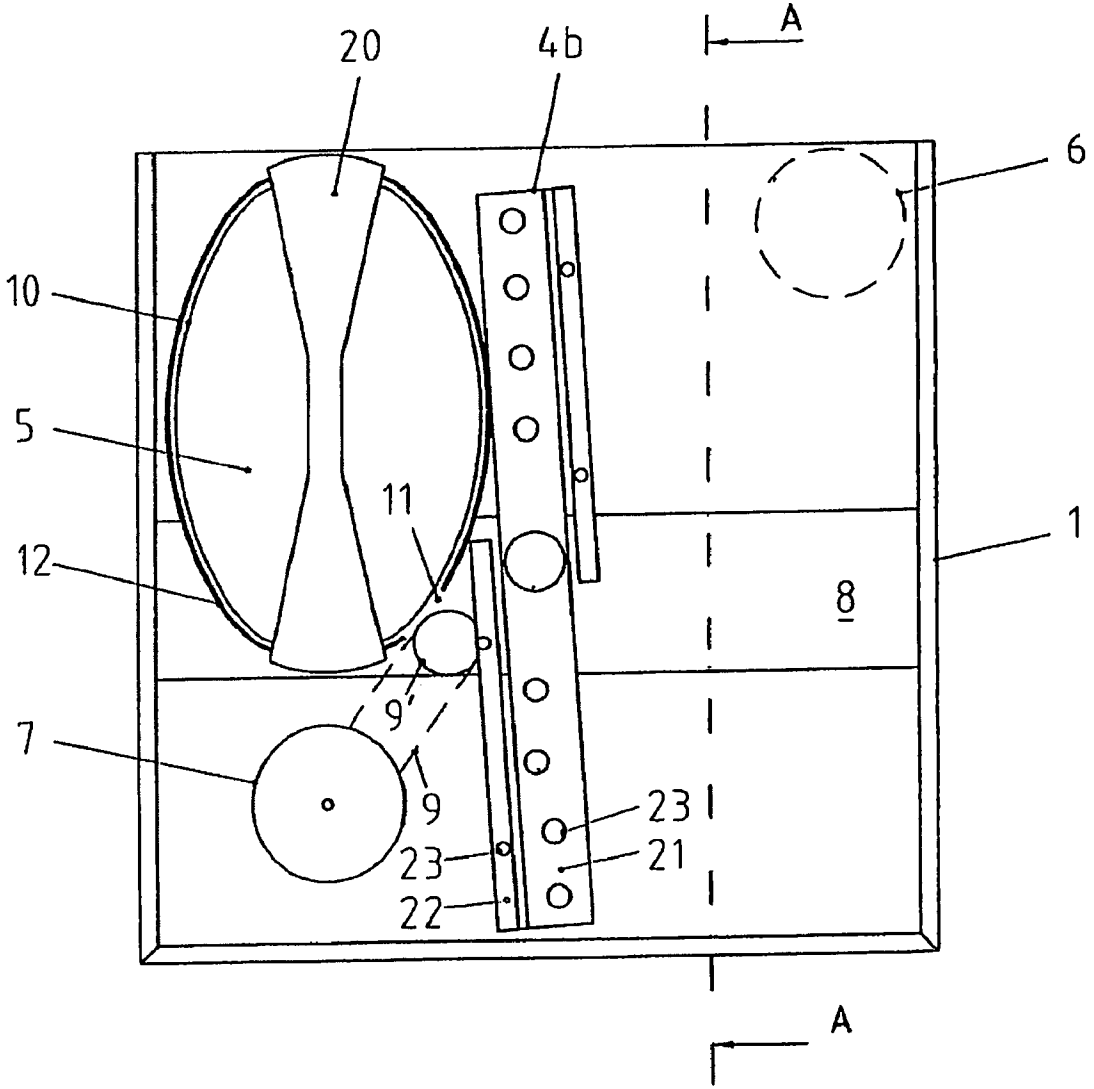
FIG. 2 is a top plan view of the dishwasher in FIG. 1, the hood being removed.
Figure 3:
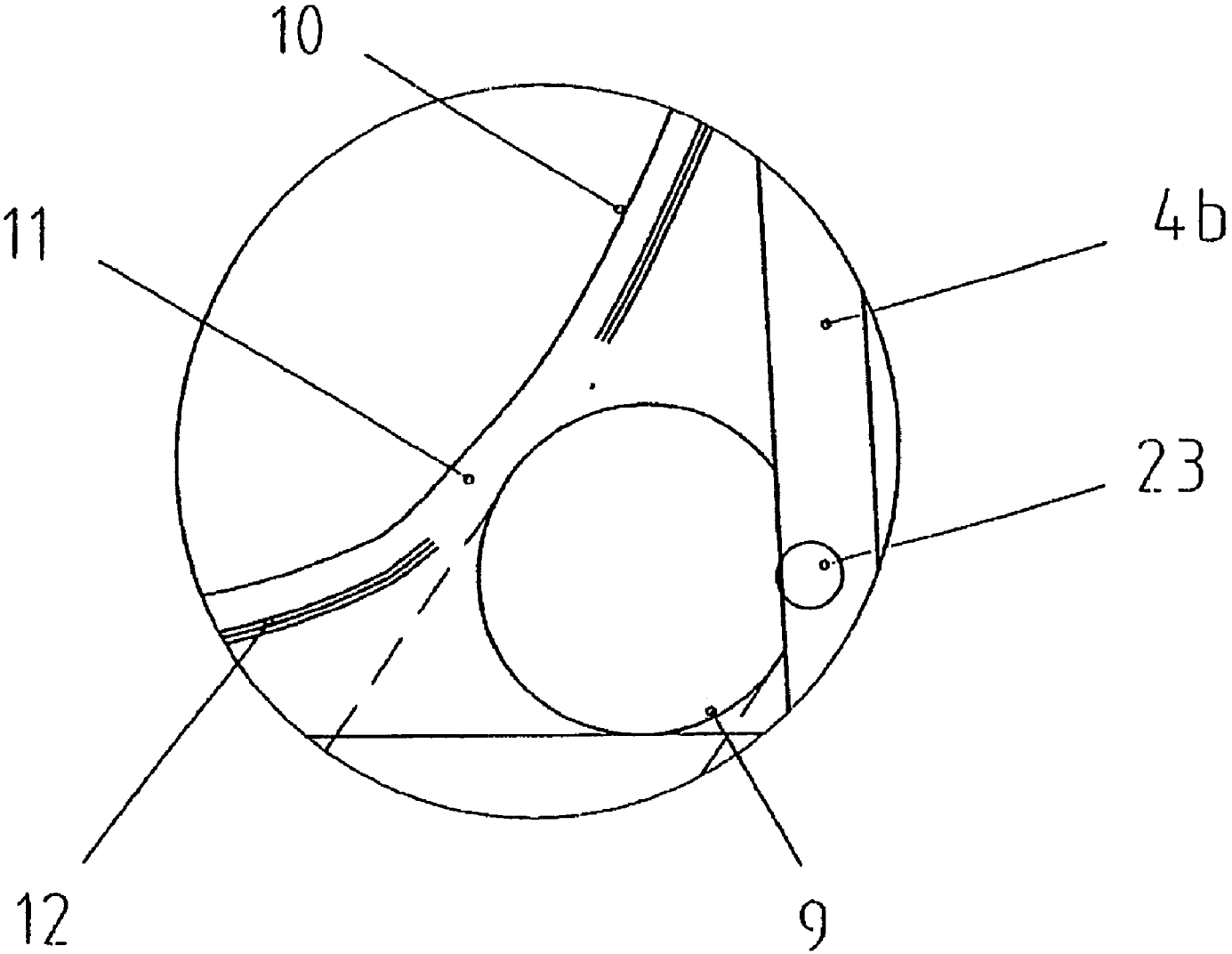
FIG. 3 illustrates a portion of FIG. 2 on a larger scale.
Figure 4:
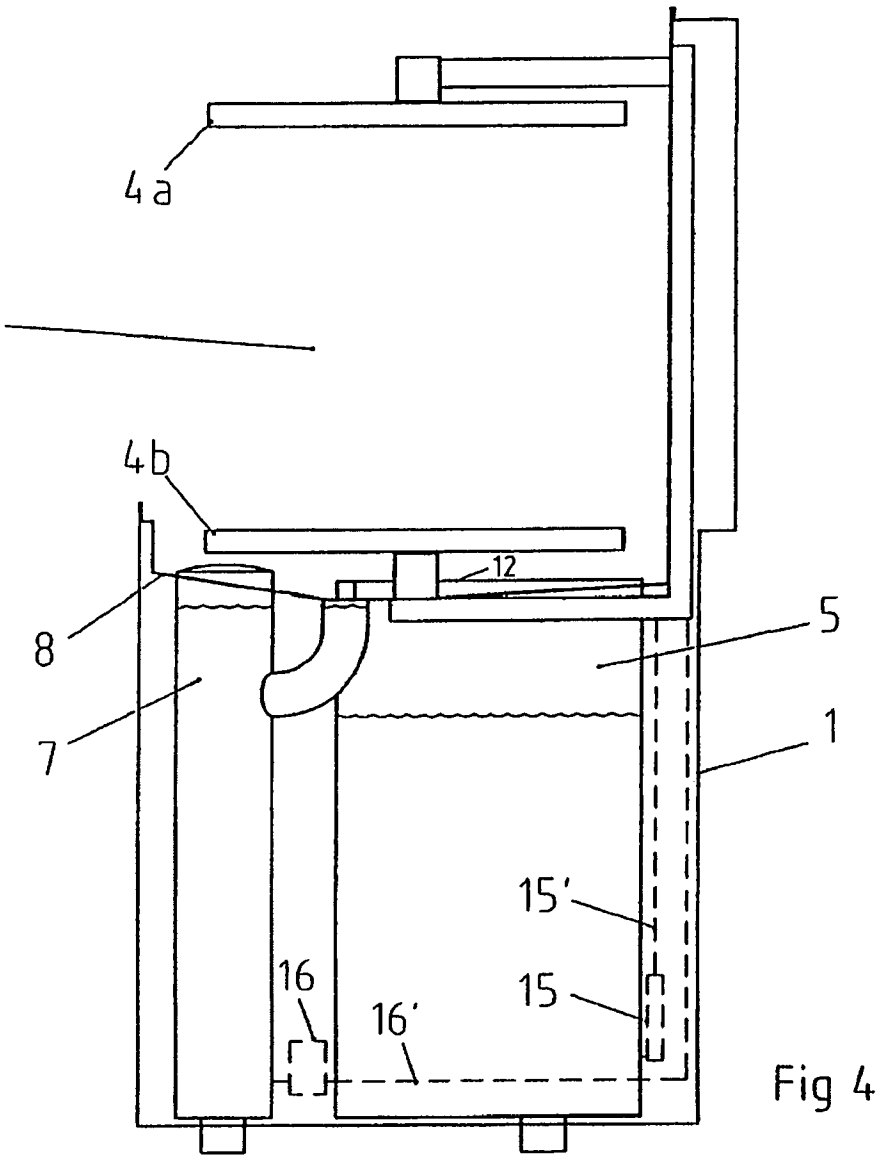
FIG. 4 is a cross-section along line A-A in FIG. 2.

As illustrated in the drawings, a dishwasher 1 according to the present invention has a dishwashing compartment 2, in which articles to be washed are arranged during a dishwashing programme. These articles are preferably arranged in a rack so that they can easily be put into and removed from the dishwasher.

Spray means in the form of an upper and a lower horizontal spray arm 4*a*, 4*b* are arranged in the dishwashing compartment 2. A dishwashing container 5, a rinsing container 6 and a recirculation rinsing container 7 are arranged under the dishwashing compartment 2.

Each container 5, 6, 7 communicates with the spray arms 4*a*, 4*b* which are rotatable about a vertical shaft. Each arm 4*a*, 4*b* has in prior-art manner a first part 21 for spraying dishwashing liquid and a second part for spraying rinsing liquid. Both parts 21, 22 have a plurality of nozzles 23 from which the respective liquids are sprayed to flush over the articles in the dishwashing compartment 2 from different directions. In the spraying of liquid, the arms 4*a*, 4*b* are rotated.

The dishwasher has pumps 15, 16 and valves which are known to those skilled in the art and which control the flow of liquid from the dishwashing container 5 and the recirculation rinsing container 7 of the dishwasher to the spray arms 4*a*, 4*b* through a respective conduit 15', 16' (only schematically shown). Also the rinsing container 6 has a pump (not shown) which pumps liquid to the spray arms 4*a*, 4*b* through a conduit (not shown). The major part of the liquid sprayed into the dishwashing compartment 2 from the spray arms 4*a*, 4*b* is collected by a collecting means which is an essentially horizontal collecting plate 8 arranged between the dishwashing compartment 2 and the dishwashing tank 5. In the collecting plate 8 there is formed a first through opening 9 which forms a first outlet means. The first opening 9 communicates with the recirculation rinsing container 7 through an inlet tube 9'.

In the collecting plate 8 there is also formed a second through opening 10. A circumferential frame 12 formed on the collecting plate 8 and projecting upwards from the same surrounds the second opening 10. A through hole 11 is formed in the frame 12 opposite to the first opening 9 positioned outside the frame and extends down to the plate 8. The second opening 10 and the hole 11 together form a second outlet means. The second opening 10 is arranged straight above the dishwashing container 5 and has essentially the same dimension as this. The liquid that is not collected by the collecting plate 8 flows directly down into the dishwashing container 5 through the second opening 10. The smaller the second opening 10, the larger the amount of sprayed liquid that can be collected by the collecting plate 8.

The collecting plate 8 has such an inclination relative to the horizontal plane as to conduct liquid collected thereon to the first opening 9. The frame 12 prevents liquid from flowing down in the second opening directly and conducts liquid to the first opening 9. When the recirculation rinsing container 7 is wholly or partly emptied, the liquid collected by the collecting plate 8 will flow down in the first opening 9 and into the recirculation rinsing container. However, when the recirculation rinsing container 7 is filled up with liquid, i.e. when the liquid level in the container 7 and its inlet tube 9' is on a level with the collecting plate 8, no further liquid can flow down in the first opening 9, which causes the liquid collected by the collecting plate 8 to pass the first opening 9 and flow down in the second opening 10 and into the dishwashing container 5, through the hole 11 in the frame 12.

The dishwashing programme of the dishwasher 1 comprising a dishwashing phase, a pre-rinsing phase and a rinsing phase.

During the dishwashing phase, the recirculation rinsing container 7 is completely filled with liquid and all the liquid collected by the collecting plate 8 therefore flows down into the dishwashing container 5 through the second opening 10 either directly or through the hole 11 in the frame 12. During the dishwashing phase, dishwashing liquid is recirculated in an amount of 200-500 l/min between the dishwashing container 5 and the dishwashing compartment 2. The dishwashing liquid is water to which a detergent is added and which is heated to 55-65° C. The user selects the length of dishwashing phase, about 1-3 min, depending on how dirty the articles are.

During the pre-rinsing phase, recirculation rinsing liquid is pumped from the recirculation rinsing container 7 up to the dishwashing compartment 2, of which liquid the major part then flows through the first opening 9 in the collecting plate 8 back to the recirculation rinsing container, since this is now not completely filled, and the remainder flows directly into the dishwashing container 5 through the second opening 10. This phase proceeds for 15-20 s and in this time about 5 l of recirculation rinsing liquid is recirculated.

During the rinsing phase, the articles are then finally rinsed with about 2.2 l pure rinsing liquid which is conducted from the rinsing container 6 through the spray arms 4*a*, 4*b* to the dishwashing compartment 2. The water in the rinsing container 6 is heated to 80-90° C., and a drying agent is added. During the rinsing phase, the recirculation rinsing container 7 is again filled through the first opening 9 in the collecting plate 8 before the next dishwashing phase, while at the same time part of the rinsing liquid flows directly down into the dishwashing container 5 through the second opening 10. Once the recirculation rinsing tank 7 is filled up, all the rinsing liquid flows down into the rinsing container 5, directly or indirectly.

During each dishwashing programme, an amount of liquid corresponding to the amount of pure rinsing liquid which is supplied to the rinsing container 6 is drawn off from the dishwasher 1.

For collecting food scraps and articles that could damage the pump 15 of the dishwashing container 5, a screen (not shown) is arranged above the second opening 10, said screen being a perforated metal sheet of essentially the same shape as the opening 10 and being provided with a superposed handle 20 which forms a further collecting means. The handle 20 has the form of a channel extending over part of the second opening 10 and conducts liquid to the collecting plate 8.

Also the recirculation rinsing container 7 has a screen (not shown) which prevents articles from entering this container.

A person skilled in the art will appreciate that the collecting means 8 according to the invention may, of course, be designed in manners other than the one described here. The first outlet means could, in addition to the first opening 9, comprise a channel extending round the second opening 10 and communicating with the first opening 9. The second opening 10 in the collecting plate 8 could be replaced with a second outlet means consisting of an inlet tube, which extends to the dishwashing container 5 and whose inlet is arranged in the plate 8 in a position located downstream of the first outlet means with respect to an inclined portion of the plate.

The invention claimed is:

1. A one compartment dishwasher, comprising:

a dishwashing compartment which is adapted to contain articles to be washed and in which spray means for spraying dishwashing liquid and rinsing liquid are arranged, a dishwashing container, which is arranged under the dishwashing compartment and adapted to contain dishwashing liquid which in a dishwashing phase is to be supplied to the dishwashing compartment by the spray means, and a rinsing container, which is adapted to contain rinsing liquid which in a rinsing phase is to be supplied to the dishwashing compartment by the spray means, wherein the dishwashing container communicates with the dishwashing compartment to receive, through a collecting means, dishwashing liquid and rinsing liquid which have been discharged by the spray means, wherein a recirculation rinsing container is arranged under the dishwashing compartment and adapted to contain recirculation rinsing liquid, which in a pre-rinsing phase preceding the rinsing phase is to be supplied to the dishwashing compartment by the spray means, the collecting means having a first outlet means which is adapted to flow liquid collected by the collecting means to the recirculation rinsing container, and a second outlet means which is adapted to flow liquid collected by the collecting means to the dishwashing container when the recirculation rinsing container is filled up.

2. A dishwasher as claimed in claim 1, in which the collecting means is a collecting plate which is arranged between the dishwashing compartment and the dishwashing container and which has a first through opening which communicates with the recirculation rinsing container and forms said first outlet means, and a second through opening which communicates with the dishwashing container in which a circumferential frame is arranged, said frame projecting upwards from the collecting plate, the second outlet means including a hole formed in the frame and said second opening, and said first opening being arranged close to the frame and essentially opposite to the hole.

3. A dishwasher as claimed in claim 1,in which the collecting plate is inclined relative to a horizontal plane in such a manner as to conduct liquid collected thereon to the first outlet means.

4. A dishwasher as claimed in claim 2, in which a further collecting means for liquid, which has been discharged by the spray means, is arranged over at least part of the second opening to conduct said liquid to the collecting plate.

5. A dishwasher as claimed in claim 4, in which the second collecting means includes a channel arranged over said part of the second opening.

* * * * *